US010710225B2

(12) United States Patent
Lai et al.

(10) Patent No.: US 10,710,225 B2
(45) Date of Patent: Jul. 14, 2020

(54) NAIL GUN HAVING PROTECTION STRUCTURE

(71) Applicant: BASSO INDUSTRY CORP., Taichung (TW)

(72) Inventors: Chun-Chi Lai, Taichung (TW); Chien-An Liu, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 425 days.

(21) Appl. No.: 15/274,206

(22) Filed: Sep. 23, 2016

(65) Prior Publication Data

US 2017/0095917 A1 Apr. 6, 2017

(30) Foreign Application Priority Data

Oct. 2, 2015 (TW) ..... 104215854 U

(51) Int. Cl.
*B25C 1/00* (2006.01)
*B25C 1/04* (2006.01)

(52) U.S. Cl.
CPC ..... *B25C 1/008* (2013.01); *B25C 1/001* (2013.01); *B25C 1/04* (2013.01); *B25C 1/047* (2013.01)

(58) Field of Classification Search
CPC B25C 1/008; B25C 1/001; B25C 1/04; B25C 1/047; B25C 1/188
USPC ..... 227/119, 120, 122, 123, 127, 128, 121, 227/124, 125, 129, 136
See application file for complete search history.

(56) References Cited

U.S. PATENT DOCUMENTS 3,061,147 A * 10/1962 Vilmerding ..... B23P 19/003 221/207
3,099,011 A * 7/1963 Wandel ..... B25C 1/041 173/127
3,152,335 A * 10/1964 Wandel ..... B25C 5/0257 227/120
3,516,590 A * 6/1970 Timmerbell ..... B25C 1/005 227/123
3,853,257 A * 12/1974 Perkins ..... B25C 5/06 227/123
4,304,349 A * 12/1981 Novak ..... B25C 1/047 206/338

(Continued)

FOREIGN PATENT DOCUMENTS

EP 100105 A2 * 2/1984 ..... B25C 1/00

*Primary Examiner* — Thanh K Truong
*Assistant Examiner* — David G Shutty
(74) *Attorney, Agent, or Firm* — Chun-Ming Shih; HDLS IPR Services

(57) ABSTRACT

A nail gun having a protection structure includes a body, a protection cover and a resilient release. The body includes a nail magazine loaded with nails and includes a barrel connected to the nail magazine. One end of the barrel has a nozzle, and the nail magazine forms a notch close to the nozzle and includes a fastening recess. The protection cover is slidably disposed on the nail magazine. The protection cover includes an engagement board, a sliding board connected to the same, and an engagement hole formed on the engagement board. The resilient release is resiliently assembled in the fastening recess and contacts and presses against an inner edge of the engagement hole, so that the protection cover is positioned by the resilient release, and the sliding board covers the notch.

10 Claims, 7 Drawing Sheets

(56) References Cited

U.S. PATENT DOCUMENTS 4,467,952 A * 8/1984 Morrell, Jr. ..... B25C 5/1665 227/123
4,597,517 A * 7/1986 Wagdy ..... B25C 1/008 227/120
5,322,189 A * 6/1994 Oda ..... B25C 1/005 221/227
5,335,800 A * 8/1994 Liu ..... B21J 15/32 221/198
5,363,999 A * 11/1994 Braun ..... B25C 5/1624 227/119
5,649,660 A * 7/1997 Akiba ..... B25C 5/1665 227/8
5,653,371 A * 8/1997 Hou ..... B25C 1/005 227/109
5,730,350 A * 3/1998 Lin ..... B25C 1/005 227/120
6,149,046 A * 11/2000 Ho ..... B25C 1/005 227/120
6,679,414 B2 * 1/2004 Rotharmel ..... B25C 1/184 227/119
7,028,875 B1 * 4/2006 Beville ..... B25C 1/04 227/119
7,753,244 B2 * 7/2010 Nagata ..... B25C 1/184 227/120
8,006,881 B2 * 8/2011 Arata ..... B25C 1/005 227/120
8,899,460 B2 * 12/2014 Wojcicki ..... B25C 1/005 227/119
2003/0218044 A1 * 11/2003 Laubach ..... B25C 1/005 227/109
2006/0213946 A1 * 9/2006 Shkolnikov ..... B25C 1/005 227/8
2006/0255088 A1 * 11/2006 Kubo ..... B25C 1/008 227/119
2007/0246502 A1 * 10/2007 Liu ..... B25C 5/161 227/120
2008/0197165 A1 * 8/2008 Chen ..... B25C 1/008 227/8
2009/0050667 A1 * 2/2009 Po ..... B25C 1/005 227/120
2009/0050668 A1 * 2/2009 Jian ..... B25C 1/005 227/126
2009/0072000 A1 * 3/2009 Iijima ..... B25C 1/188 227/109
2009/0072002 A1 * 3/2009 Ishizawa ..... B25C 5/13 227/120
2010/0001034 A1 * 1/2010 Huang ..... B25C 1/04 227/120
2010/0276467 A1 * 11/2010 Kramer ..... B25C 1/008 227/8
2011/0017798 A1 * 1/2011 Lawrence ..... B25C 1/047 227/123
2011/0062208 A1 * 3/2011 Hlinka ..... B25C 1/008 227/8
2012/0085806 A1 * 4/2012 Lee ..... B25C 1/008 227/8
2012/0111915 A1 * 5/2012 Miyashita ..... B25C 1/06 227/8
2013/0032458 A1 * 2/2013 Anderst ..... H01H 13/14 200/345
2013/0119107 A1 * 5/2013 Cheung ..... B25C 1/008 227/8
2013/0153383 A1 * 6/2013 Liang ..... H01H 3/122 200/345
2014/0034701 A1 * 2/2014 Komazaki ..... B25C 1/047 227/8
2015/0041297 A1 * 2/2015 Fan ..... H01H 13/14 200/345
2015/0239113 A1 * 8/2015 Waterman ..... B25C 7/00 227/120
2015/0364271 A1 * 12/2015 Huang ..... H01H 13/14 74/491
2016/0325420 A1 * 11/2016 Krout ..... B25C 1/008
2017/0095917 A1 * 4/2017 Lai ..... B25C 1/001
2017/0120432 A1 * 5/2017 Brendel ..... B25C 1/008

* cited by examiner

NAIL GUN HAVING PROTECTION STRUCTURE

TECHNICAL FIELD

The present invention relates to a nail gun and, in particular, to a nail gun having a protection structure, which allows a protection cover to be moved without tools.

BACKGROUND

Pneumatic nail guns with angle have been extensively used in interior decorating, and furniture industry. During operations of conventional nail guns, users may install nails in a wrong direction or at a wrong angle, and the nails may have inferior quality. Consequently, when the nail gun shoots nails, the nails become inverted or jammed/wedged. In this case, the nail is likely fired from a gun channel of a gun barrel instead of a gun nozzle, which may result in harm to the user.

In order to prevent this problem, the conventional nail gun additionally includes a steel protection cover at the gun nozzle and a channel base, so as to prevent nails from being fired from the gun channel to harm the user. However, when the nails are jammed or inverted, it is required to unfasten the screws of the steel protection cover by tools, and then the protection cover can be removed for taking out the jammed nails. This is inconvenient for users, and the screws can be lost so easily that the steel protection cover cannot be fastened well.

Accordingly, it is the aim of the present invention to overcome operation and fastening problems of the protection cover.

SUMMARY

It is an object of the present to provide a nail gun having a protection structure, which allows a protection cover to be moved without tools, thereby improving convenience in operation and providing enhanced safety for users.

Accordingly, the present invention provides a nail gun having a protection structure. The nail gun includes a body, a protection cover and a resilient release. The body includes a nail magazine loaded with a plurality of nails and includes a barrel connected to the nail magazine. One end of the barrel includes a nozzle. The nail magazine forms a notch close to the nozzle. The nail magazine further includes a fastening recess. The protection cover is slidably disposed on the nail magazine. The protection cover includes an engagement board, a sliding board connected to the engagement board, and an engagement hole formed on the engagement board. The resilient release is resiliently assembled in the fastening recess, and the resilient release contacts and presses against an inner edge of the engagement hole of the protection cover, so that the protection cover is positioned by the resilient release, and the sliding board covers the notch.

The present invention further has the following functions. By bringing a T-shaped bolt having a first chamfer into engagement with the engagement hole having a second chamfer, the protection cover can be engaged with the resilient release, so that the protection cover can be positioned. When it is desired to move the protection cover, simply by pressing the resilient release, the protection cover can be separated from the T-shaped bolt of the resilient release, thereby facilitating easy operations and protecting users.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
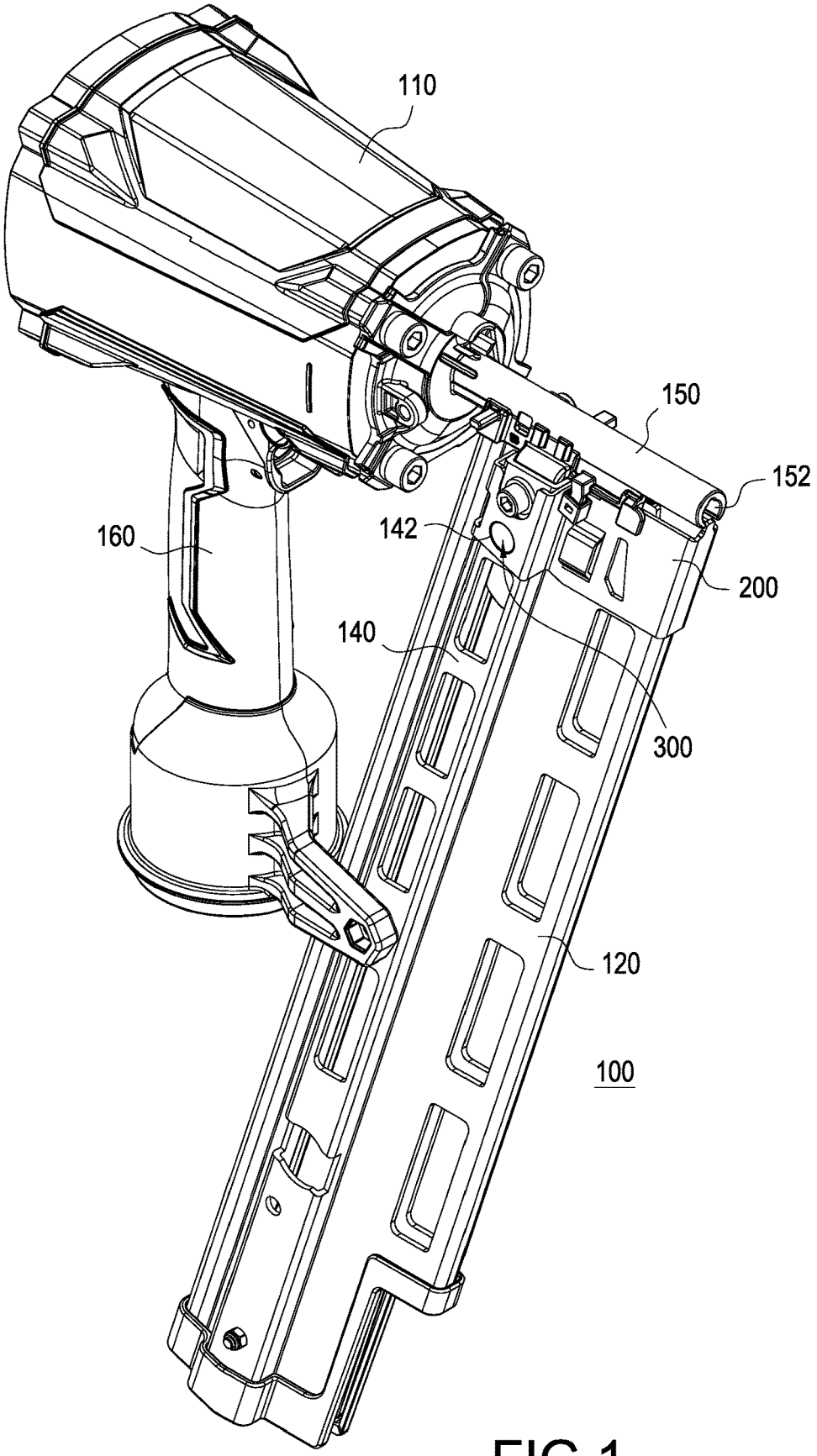
FIG. 1 is a perspective view illustrating a nail gun having a protection structure according to the present invention.
Figure 2:
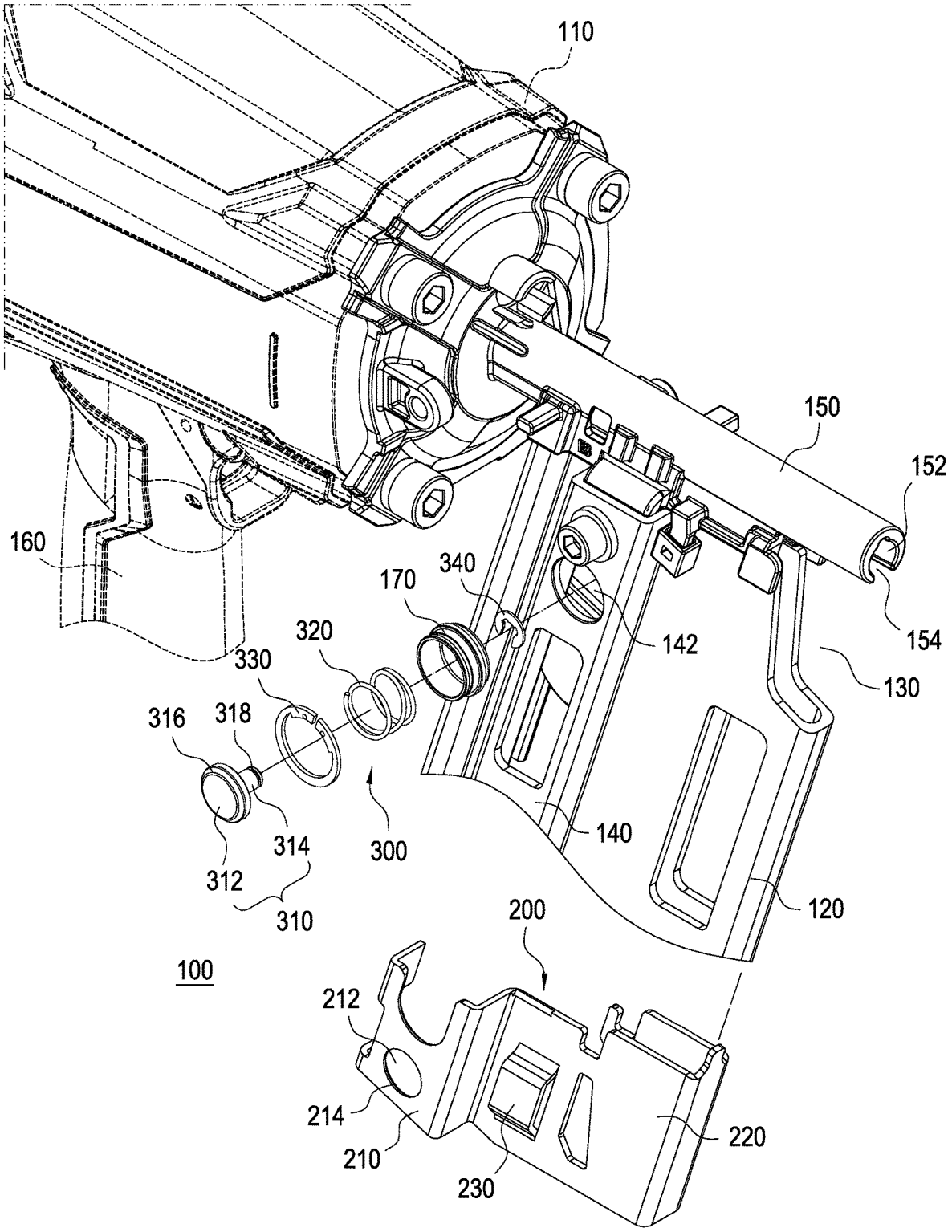
FIG. 2 is a partial exploded view illustrating the nail gun having the protection structure according to the present invention.
Figure 3:
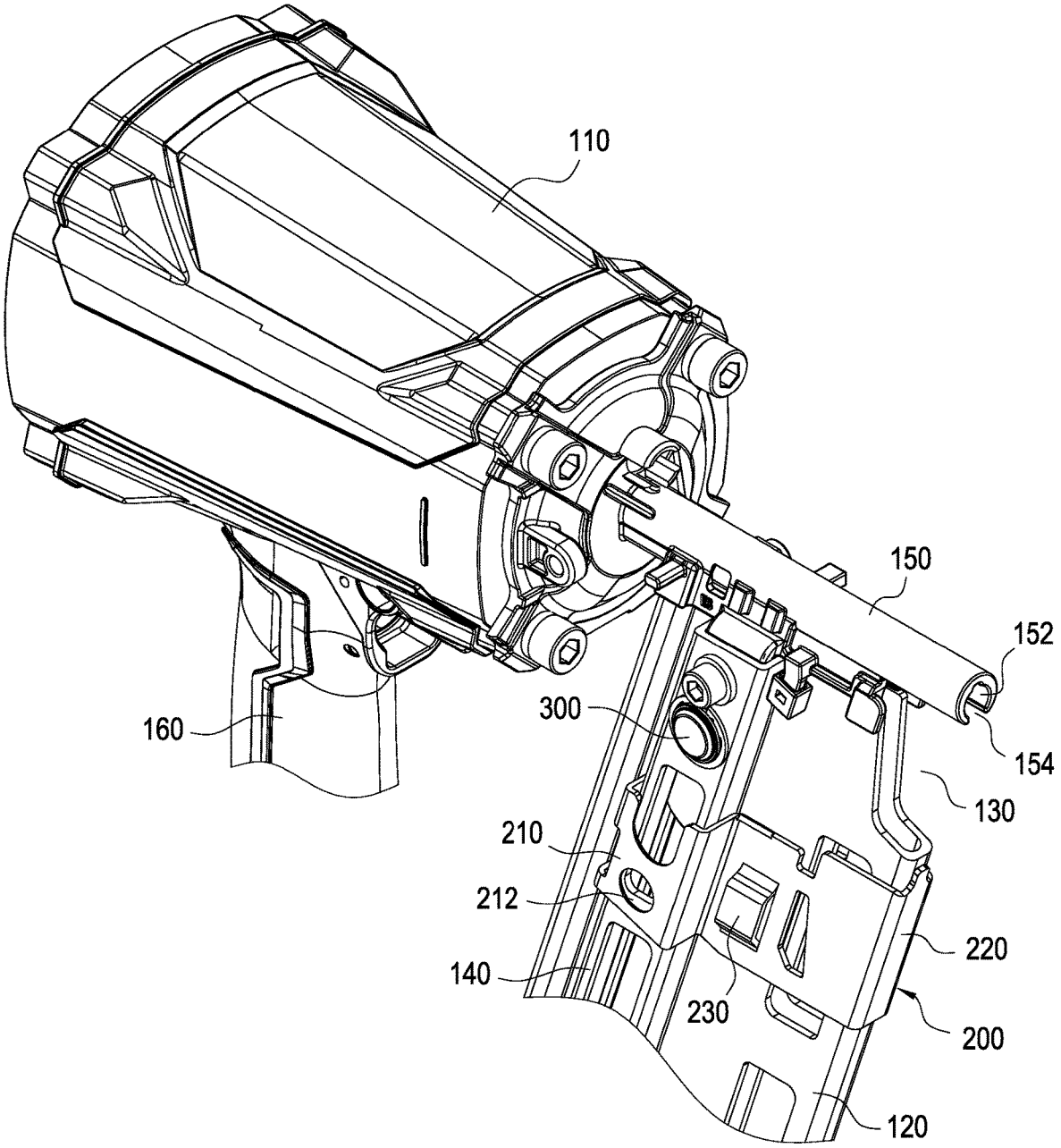
FIG. 3 is a partial perspective view illustrating the nail gun having the protection structure according to the present invention.

Referring to FIGS. 1 to 3, the present invention provides a nail gun 100 having a protection structure. The nail gun 100 includes a body 110, a protection cover 200 and a resilient release 300. The nail gun 100 herein is preferably a pneumatic nail gun with angle. The nail gun 100 includes, but not limited to, 22-degree, 28-degree, and 34-degree guns.

The body 110 includes a nail magazine 120 loaded with a plurality of nails (not illustrated) and includes a barrel 150 connected to the nail magazine 120. One end of the barrel 150 includes a nozzle 152 for the nails to be shot therefrom. The nail magazine 120 forms a notch 130 close to the nozzle 152, wherein the nail magazine 120 forms a fastening recess 142. As shown in FIG. 1, the body 110 further includes a handle 160, and the nail magazine 120 is connected and fixed to the barrel 150 and one end of the handle 160.

The protection cover 200 is slidably disposed on the nail magazine 120. The protection cover 200 includes an engagement board 210, a sliding board 220 connected to the engagement board 210, and an engagement hole 212 formed on the engagement board 210. As shown in FIG. 2, the nail magazine 120 further includes a protruding rib 140, the fastening recess 142 is formed on the protruding rib 140, and the protection cover 200 includes the engagement board 210 disposed corresponding to the protruding rib 140. The engagement board 210 is a U-shaped plate with respect to the protruding rib 140, and the sliding board 220 is a C-shaped board with respect to a side edge of the nail magazine 120, so that the protection cover 200 is engaged with and movable along an outer side wall of the nail magazine 120. However, in other different embodiments, the shape of the engagement board 210 or the sliding board 220 may vary as required, and is not limited by the present invention.

Figure 4:
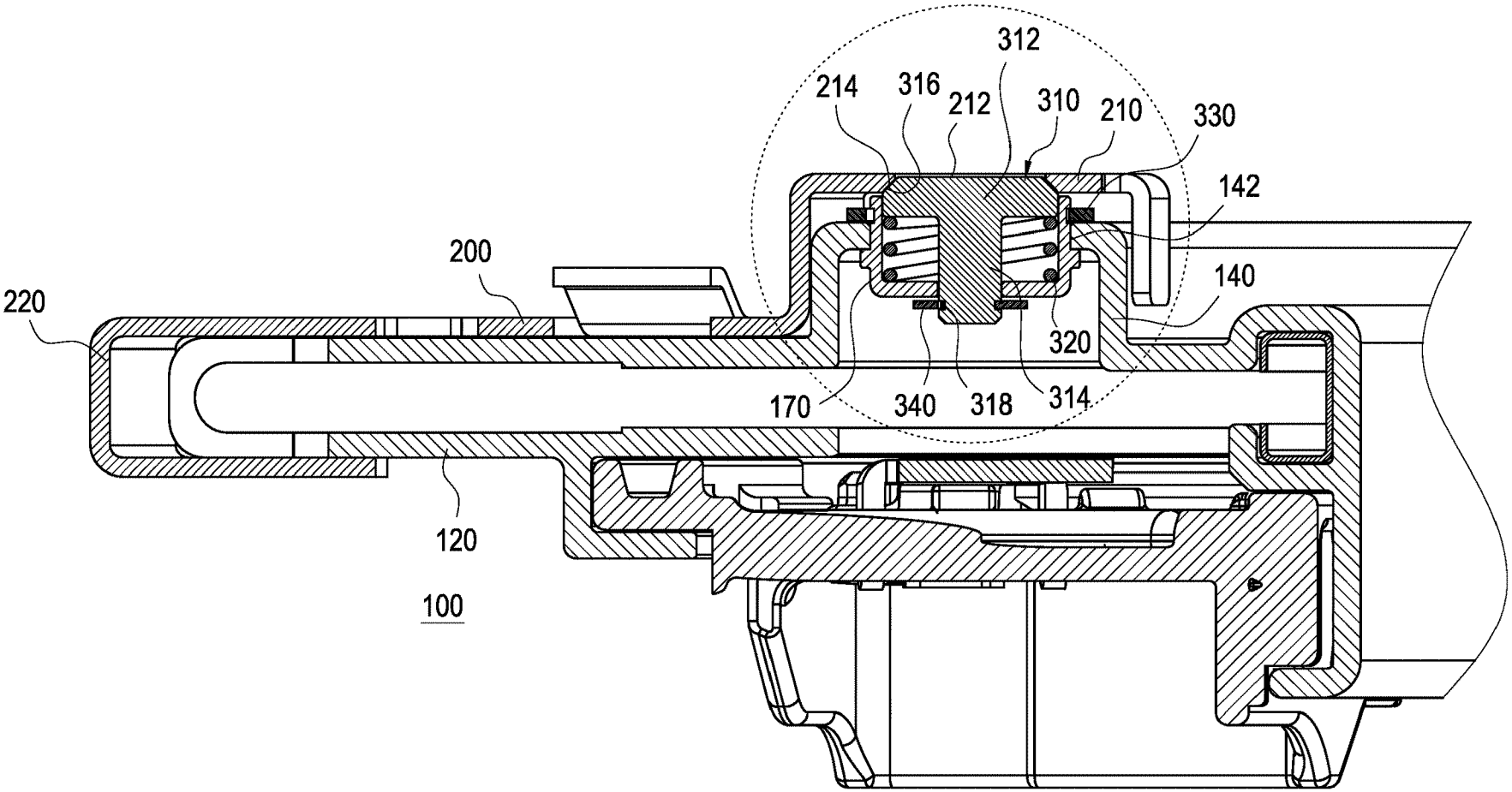
FIG. 4 is a partial cross-sectional view illustrating the nail gun having the protection structure according to the present invention.
Figure 5:
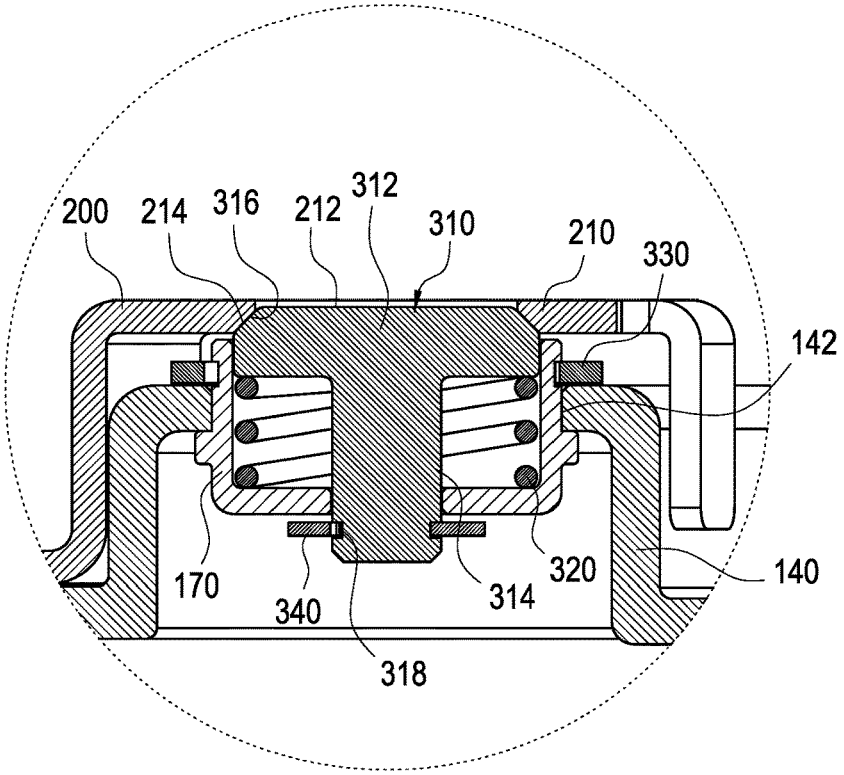
FIG. 5 is a partial enlarged view of the present invention, illustrating a protection cover engaged with a resilient release.
Figure 6:
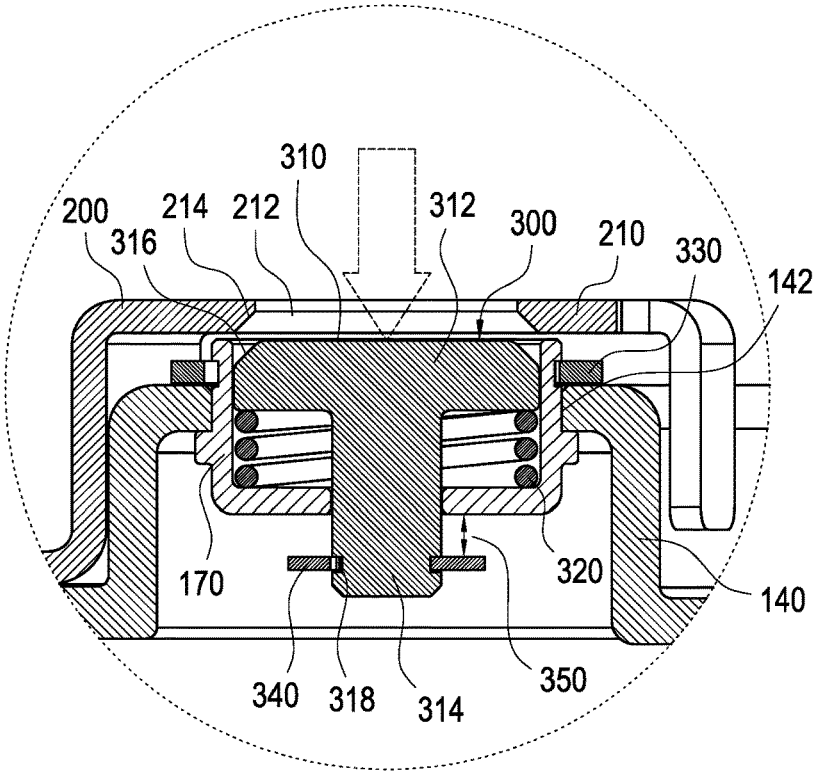
FIG. 6 is a partial enlarged view of the present invention, illustrating the protection cover detached from the resilient release.

The resilient release 300 is resiliently assembled in the fastening recess 142. The resilient release 300 contacts and presses against an inner edge of the engagement hole 212 of the protection cover 200, so that the protection cover 200 is positioned by the resilient release 300, and the sliding board 220 covers the notch 130. Referring to FIGS. 4, 5 and 6, the present embodiment further includes a sleeve member 170 received in the fastening recess 142. The resilient release 300 includes a T-shaped bolt 310, an elastic element 320, a first fastening ring 330, and a second fastening ring 340, wherein the T-shaped bolt 310 includes a head portion 312 having a first chamfer 316 and includes a rod portion 314 connected to the head portion 312.

In the embodiment shown in FIG. 4, the first fastening ring 330 is fastened onto an outer periphery of the sleeve member 170, so that the sleeve member 170 is positioned on the fastening recess 142 of the protruding rib 140. In the embodiment shown in FIG. 5 and FIG. 6, two ends of the elastic element 320 are respectively in contact with an inner surface of the head portion 312 and a bottom end of the sleeve member 170, so that the T-shaped bolt 310 is resiliently movable in the sleeve member 170. The elastic element 320 is preferably a compression spring, a coil spring, or the likes, and the present invention is not limited in this regard.

As shown in FIG. 5, an inner periphery of the engagement hole 212 further includes a second chamfer 214 corresponding to the first chamfer 316 of the head portion 312 so as to position the first chamfer 316. As shown in FIG. 6, the rod portion 314 forms a groove 318 for engaged with the second fastening ring 340. Therefore, the second fastening ring 340 can be fastened onto the rod portion 314 of the T-shaped bolt 310, so that the second fastening ring 340 has a movement distance 350 with respect to the bottom end of the sleeve member 170. As a result, the T-shaped bolt 310 is resiliently movable along a movement distance 350 with respect to the sleeve member 170, and the T-shaped bolt 310 is limited in the fastening recess 142 by the second fastening ring 340.

When the protection cover 200 slides to engage the resilient release 300 into position, the T-shaped bolt 310 moves downwardly due to a force of the elastic element 320. By means of the force of the elastic element 320, the T-shaped bolt 310 springs up, so that the first chamfer 316 of the head portion 312 and the second chamfer 214 of the engagement hole 212 are engaged into position. When pressing the resilient release 300, the first chamfer 316 of the T-shaped bolt 310 is separated from the second chamfer 214 of the protection cover 200, so the sliding board 220 of the protection cover 200 can be moved to expose the notch 130 of the nail magazine 120.

Regarding the first chamfer 316 and the second chamfer 214, with a greater depth or surface, the first chamfer 316 and the second chamfer 214 have enhanced stability and reliability when engaged with each other. Then, consequently, the movement distance 350 of the T-shaped bolt 310 needs to be larger to make the first chamfer 316 separated from the second chamfer 214.

Furthermore, according to the present embodiment, the protection cover 200 includes a push bump 230. As shown in the drawing, the push bump 230 is preferably disposed between the engagement board 210 and the sliding board 220 to facilitate pushing the protection cover 200 to move with respect to the nail magazine 120. However, in other different embodiments, the push bump 230 can be disposed on the engagement board 210 or the sliding board 220, and the present invention is not limited in this regard. In addition, the structure for pushing the protection cover 200 is not limited to the design shown in the drawing, and the structure can be an embossed pattern or other suitable structure which enables the user to push easily.

Figure 8:
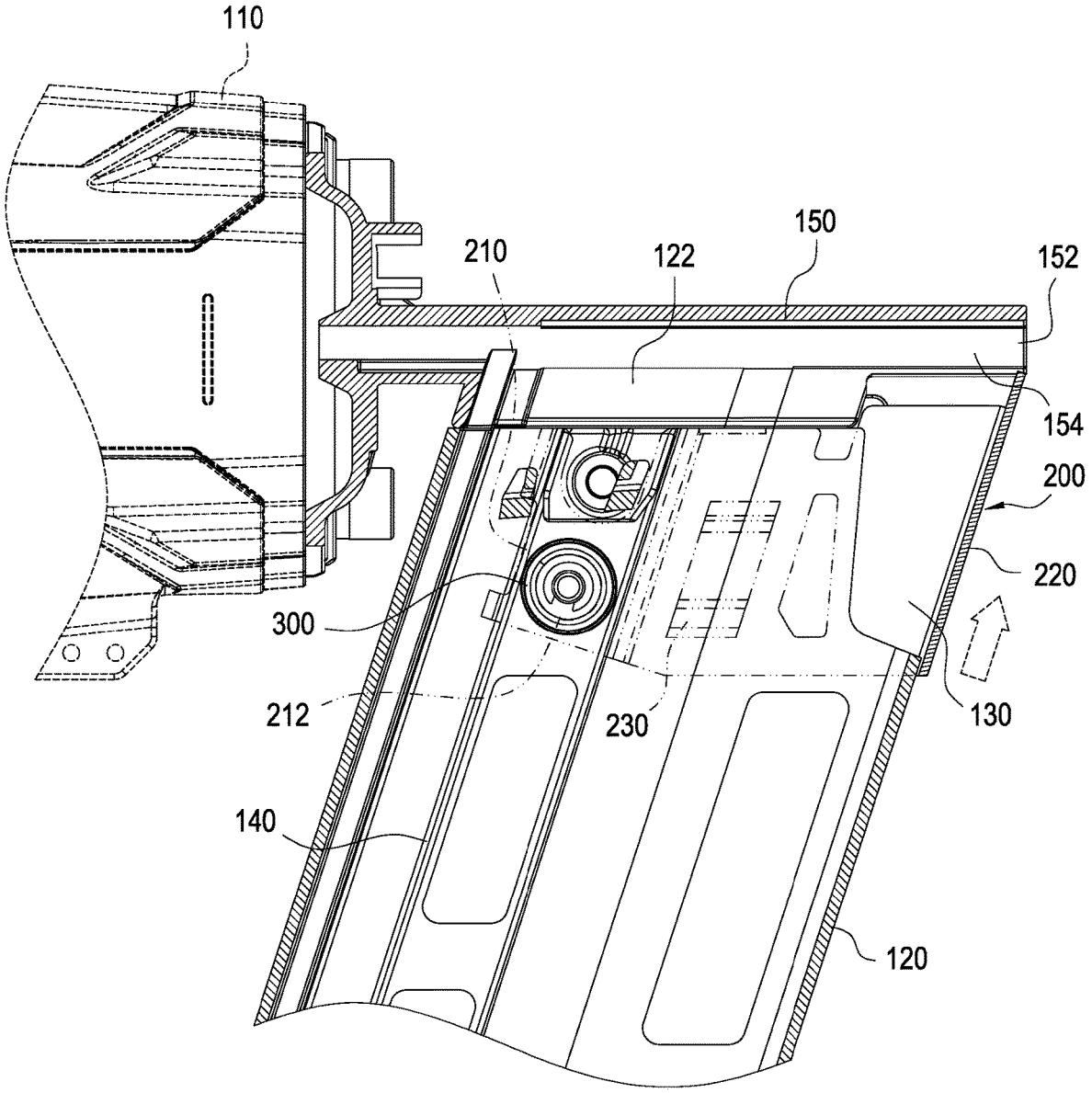
FIG. 8 is a partial cross-sectional view of the present invention, illustrating the protection cover engaged with the resilient release.

Moreover, when the body 110 has inverted nails or jammed nails (not illustrated), the nails can be shot from other places rather than the nozzle 152. In most cases, the nail (not illustrated) is shot from a gun channel 154 in communication with a nail outlet 122. In other words, the nail is shot from the notch 130 of the nail magazine 120, which may result in harm to the user. Therefore, when using the nail gun 100 in normal condition, as shown in FIG. 8, the protection cover 200 is engaged in position with the resilient release 300 on the nail magazine 120, and by utilizing the sliding board 220 to cover the notch 130, the nail is prevented from being shot from the notch 130, and the user is prevented from being harmed.

Figure 7:
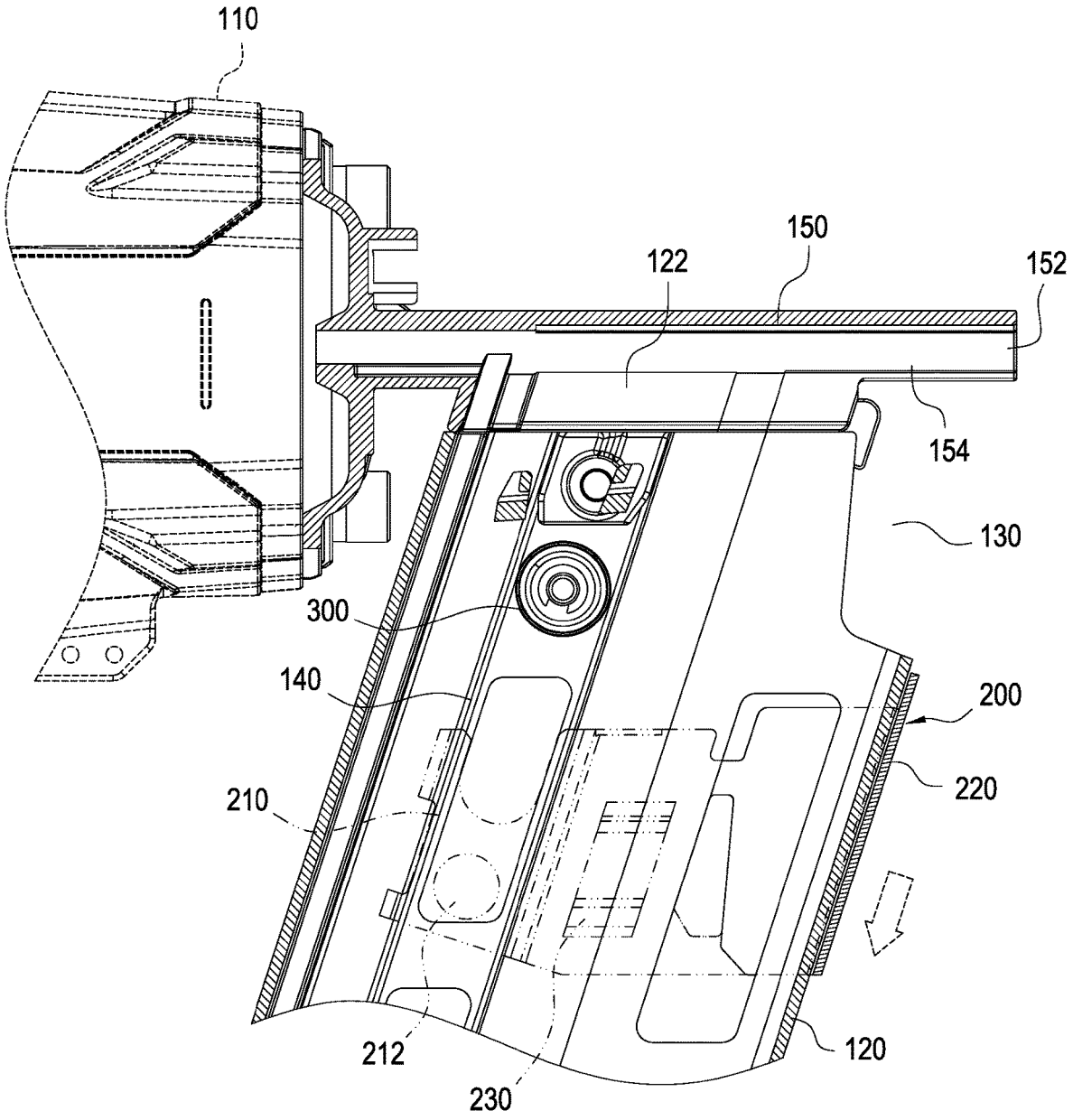
FIG. 7 is a partial cross-sectional view of the present invention, illustrating the protection cover detached from the resilient release.

However, when the nail (not illustrated) becomes jammed or inverted, or the nail has to be taken out for other reasons, the user needs to remove the protection cover 200 to make the notch 130 exposed from the sliding board 220, and thereby the user can take out or rearrange the nails, as shown in FIG. 7. That is to say, the user only needs to press the resilient release 300 to make the protection cover 200 detached from the resilient release 300, and then the notch 130 can be exposed from the sliding board 220. Accordingly, by utilizing the present invention, the protection cover 200 can be removed without any tools, thus facilitating easy operations and providing enhanced safety for the user.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A nail gun having a protection structure, comprising:

a body, the body including a nail magazine for loading nails and including a barrel connected to the nail magazine, one end of the barrel including a nozzle and a gun channel, a corner of the nail magazine being truncated to form a notch communicating with the gun channel, wherein the nail magazine further includes a fastening recess;

a protection cover, the protection cover being slidably disposed on the nail magazine, the protection cover including an engagement board, a C-shaped sliding board connected to the engagement board and covering two opposite surfaces of the nail magazine, and an engagement hole formed on the engagement board, wherein the engagement board, the C-shaped sliding board, and the engagement hole are integrally formed in one piece; and a resilient release, the resilient release being resiliently assembled in the fastening recess, the resilient release contacting and pressing against an inner edge of the engagement hole of the protection cover, so that the protection cover is positioned by the resilient release, and the C-shaped sliding board covers all of the notch, wherein the C-shaped sliding board covers the notch to prevent the nails from being shot out from the notch.

2. The nail gun having the protection structure of claim 1, wherein the nail magazine further includes a protruding rib, the fastening recess is formed on the protruding rib, and the protection cover includes the engagement board disposed corresponding to the protruding rib.

3. The nail gun having the protection structure of claim 2, wherein the engagement board is a U-shaped plate.

4. The nail gun having the protection structure of claim 1, further comprising a sleeve member received in the fastening recess, the resilient release including a T-shaped bolt, an elastic element, a first fastening ring, and a second fastening ring, wherein the T-shaped bolt includes a head portion having a first chamfer and includes a rod portion connected to the head portion.

5. The nail gun having the protection structure of claim 4, wherein two ends of the elastic element are respectively in contact with an inner surface of the head portion and a bottom end of the sleeve member, so that the T-shaped bolt is resiliently movable in the sleeve member.

6. The nail gun having the protection structure of claim 4, wherein the first fastening ring is fastened to an outer periphery of the sleeve member, so that the sleeve member is positioned on the fastening recess of the nail magazine.

7. The nail gun having the protection structure of claim 4, wherein the second fastening ring is fastened to the rod portion of the T-shaped bolt, so that the second fastening ring has a movement distance with respect to a bottom end of the sleeve member.

8. The nail gun having the protection structure of claim 4, wherein an inner periphery of the engagement hole further includes a second chamfer corresponding to the first chamfer of the head portion so as to position the first chamfer.

9. The nail gun having the protection structure of claim 1, wherein the protection cover further includes a push bump.

10. The nail gun having the protection structure of claim 9, wherein the push bump is disposed between the engagement board and the C-shaped sliding board to facilitate pushing the protection cover to move with respect to the nail magazine.

* * * * *